US010745996B2

(12) United States Patent
Deboer

(10) Patent No.: US 10,745,996 B2
(45) Date of Patent: Aug. 18, 2020

(54) CIRCULATION VALVE

(71) Applicant: DRLG TOOLS, LLC, Richmond, TX (US)

(72) Inventor: Luc Deboer, Richmond, TX (US)

(73) Assignee: DRLG Tools, LLC, Richmond, TX (US)

( * ) Notice: Subject to any disclaimer, the term of this patent is extended or adjusted under 35 U.S.C. 154(b) by 218 days.

(21) Appl. No.: 15/738,052

(22) PCT Filed: Jun. 17, 2016

(86) PCT No.: PCT/US2016/038200
§ 371 (c)(1),
(2) Date: Dec. 19, 2017

(87) PCT Pub. No.: WO2016/205725
PCT Pub. Date: Dec. 22, 2016

(65) Prior Publication Data

US 2018/0306000 A1 Oct. 25, 2018

Related U.S. Application Data

(60) Provisional application No. 62/182,282, filed on Jun. 19, 2015.

(51) Int. Cl.
*E21B 34/10* (2006.01)
*E21B 21/10* (2006.01)
(Continued)

(52) U.S. Cl.
CPC ..... *E21B 34/10* (2013.01); *E21B 21/103* (2013.01); *E21B 34/14* (2013.01); *E21B 2034/007* (2013.01)

(58) Field of Classification Search
CPC ... E21B 21/103; E21B 2034/007; E21B 34/14
See application file for complete search history.

(56) References Cited

U.S. PATENT DOCUMENTS 4,889,199 A 12/1989 Lee
6,173,795 B1 1/2001 McGarian et al.
(Continued)

FOREIGN PATENT DOCUMENTS

CN 201306150 Y 9/2009
CN 102661130 A 9/2012
(Continued)

OTHER PUBLICATIONS

International Search Report dated Sep. 27, 2016, for International Application No. PCT/US2016/038200.
(Continued)

*Primary Examiner* — Giovanna Wright
(74) *Attorney, Agent, or Firm* — Conley Rose, P.C.

(57) ABSTRACT

A method of controlling fluid flow through a circulation valve disposed in a borehole includes flowing a fluid at a first flowrate through a first jet and a second jet disposed in a throughbore of a sliding sleeve disposed in a housing of the circulation valve, flowing the fluid at a second flowrate through the first jet and the second jet to actuate the sliding sleeve from a first position to a second position, and flowing the fluid from the throughbore of the sliding sleeve through a housing port of the housing in response to actuating the sliding sleeve from the first position to a second position.

20 Claims, 8 Drawing Sheets

(51) Int. Cl.
*E21B 34/14* (2006.01)
*E21B 34/00* (2006.01)

(56) References Cited

U.S. PATENT DOCUMENTS

| | | | | |
|---|---|---|---|---|
| 6,820,697 | B1 * | 11/2004 | Churchill | E21B 21/103 166/374 |
| 8,752,631 | B2 | 6/2014 | Stewart | |
| 9,045,966 | B2 | 6/2015 | Ali et al. | |
| 2004/0154839 | A1 * | 8/2004 | McGarian | E21B 21/103 175/324 |
| 2011/0203809 | A1 * | 8/2011 | Knobloch, Jr. | E21B 21/103 166/386 |
| 2011/0226489 | A1 | 9/2011 | Hofman et al. | |
| 2012/0106297 | A1 | 5/2012 | Fraser | |
| 2013/0025872 | A1 | 1/2013 | Mailand et al. | |
| 2015/0345253 | A1 * | 12/2015 | Braekke | E21B 21/103 166/332.1 |

FOREIGN PATENT DOCUMENTS

| | | | |
|---|---|---|---|
| CN | 102661231 | A | 9/2012 |
| CN | 104153751 | A | 11/2014 |
| CN | 104453783 | A | 3/2015 |
| WO | 2014055191 | A1 | 4/2014 |

OTHER PUBLICATIONS

Chinese First Office Action dated Jul. 19, 2019, and Search Report for Application No. CN 201680042646.3.
Chinese Second Office Action dated May 8, 2020, and Search Report for Application No. CN 201680042646.3 with English translation.

* cited by examiner

CIRCULATION VALVE

CROSS-REFERENCE TO RELATED APPLICATIONS

This application is a 35 U.S.C. § 371 national stage application of PCT/US2016/038200 filed on Jun. 17, 2016, and entitled "Circulation Valve," which claims benefit of U.S. provisional patent application Ser. No. 62/182,282 filed Jun. 19, 2015, and entitled "Annulus Boost Valve," both of which are hereby incorporated herein by reference in their entirety

STATEMENT REGARDING FEDERALLY SPONSORED RESEARCH OR DEVELOPMENT

Not applicable.

BACKGROUND

This disclosure generally relates to tools for use in a borehole extending into a subterranean formation. More particularly, the disclosure relates to downhole tools for boosting annulus flow in the borehole as part of an oilfield drilling operation of a well system.

Drilling operations may produce a borehole having a cross-sectional diameter that varies along the borehole's length. Particularly, the borehole may have a diameter that is larger near the surface and is gradually reduced moving along the length of the borehole towards the toe or bottom of the borehole. For instance, the borehole diameter may change in size between casing or liner tubular members of different diameters that line the inner surface of the borehole. Some oilfield drilling operations include a drill string that extends through the borehole and terminates at a drill bit disposed at the bottom of the borehole for cutting into the subterranean formation into which the borehole extends.

In some such drilling operations, drilling fluid or mud may be pumped down through a central passage of the drill string from mud pumps disposed at the surface to the drill bit, where the pumped mud may cool the drill bit and circulate entrained drill cuttings to the surface through an annular flowpath formed between the borehole wall and the drillstring. Due to the varying cross-sectional diameter of the borehole along its axial length, the cross-sectional area of the annular flowpath may vary along the axial length of the borehole, with the annular flowpath having a larger cross-sectional area near the surface than towards the bottom of the borehole by the drill bit. As the drilling mud and entrained drill cutting flow upwards through the annular flowpath, the flow speed of the returning fluid, commonly known as annulus velocity (AV), may decrease in response to the increasing cross-sectional area of the annular flowpath moving towards the surface. Moreover, if the AV decreases by a sufficient degree, the AV may drop below the slip velocity of the returning fluid, causing the entrained drill cuttings to settle out of the recirculating mud, thereby inhibiting the recirculating mud from carrying the drill cuttings to the surface for removal from the borehole.

BRIEF SUMMARY OF THE DISCLOSURE

An embodiment of a circulation valve comprises a housing having a throughbore and a housing port, and a sliding sleeve disposed in the throughbore of the housing and having a first radial port, wherein the sliding sleeve comprises a first jet configured to provide a first pressure drop in a fluid flowing therethrough, and disposed in a throughbore of the sliding sleeve, and a second jet configured to provide a second pressure drop in a fluid flowing therethrough, wherein the second jet is disposed in the throughbore of the sliding sleeve and is axially spaced from the first jet, wherein, when the sliding sleeve is disposed in a first position, fluid flow between the throughbore of the sliding sleeve and the housing port is restricted, and when the sliding sleeve is disposed in a second position, fluid flow between the throughbore of the sliding sleeve and the housing port is permitted, wherein the sliding sleeve is actuated between the first and second positions in response to a change in a flowrate of a fluid flow passing through the circulation valve. In some embodiments, the first jet and the second jet are each configured to allow for the passage of a tool therethrough. In some embodiments, when the sliding sleeve is in the second position, fluid communication is provided between the throughbore of the sliding sleeve and an annular flowpath surrounding the circulation valve. In certain embodiments, the circulation valve further comprises a biasing member disposed in the throughbore of the housing between an annular shoulder of the sliding sleeve and an annular shoulder of the housing to exert a biasing force against the sliding sleeve. In certain embodiments, in response to a first flow rate of fluid flowing through the circulation valve, the biasing member retains the sliding sleeve in the first position, in response to a second flow rate of fluid flowing through the circulation valve, the sliding sleeve is actuated from the first position to the second position; and the second flow rate is greater than the first flow rate. In some embodiments, the sliding sleeve is actuated from the first position to the second position in response to a pressure force applied to the sliding sleeve from the first pressure drop and the second pressure drop in a fluid flow through the first jet and the second jet. In some embodiments, a jet is disposed in the housing port configured to provide a pressure drop in a fluid flowing therethrough. In certain embodiments, the sliding sleeve further comprises an annular groove extending into an outer surface of the sliding sleeve, wherein the annular groove is axially aligned with the first radial port.

An embodiment of a circulation valve comprises a housing having a throughbore and a housing port having a jet disposed therein, wherein the jet is configured to provide a pressure drop in a fluid flowing therethrough, and a sliding sleeve disposed in the throughbore of the housing, wherein the sliding sleeve comprises a throughbore and a first radial port, wherein, when the sliding sleeve is disposed in a first position, fluid flow between the throughbore of the sliding sleeve and the housing port is restricted, wherein, when the sliding sleeve is disposed in a second position, fluid flow between the throughbore of the sliding sleeve and the housing port is permitted, wherein, in response to a fluid flow through the circulation valve, a first pressure drop is created in the fluid flow at a first flow restriction disposed in the throughbore of the sliding sleeve, and a second pressure drop is created in the fluid flow at a second flow restriction disposed in the throughbore of the sliding sleeve. In some embodiments, the sliding sleeve is actuated between the first and second positions in response to a change in a flowrate of a fluid flow passing through the circulation valve, and the jet disposed in the housing port is configured to divert a preselected portion of the fluid flow entering the circulation valve through the first radial port of the sliding sleeve. In some embodiments, the first pressure drop is greater than the second pressure drop. In certain embodiments, the sliding sleeve further comprises a first jet disposed in the throughbore of the sliding sleeve, wherein the first jet configured to provide the first pressure drop in response to the fluid flow, and a second jet disposed in the throughbore of the sliding sleeve and axially spaced from the first jet, wherein the second jet configured to provide the second pressure drop in response to the fluid flow. In some embodiments, the first jet and the second jet are each configured to allow for the passage of a tool therethrough. In some embodiments, when the sliding sleeve is in the second position, fluid communication is provided between the throughbore of the sliding sleeve and an annular flowpath surrounding the circulation valve. In certain embodiments, the circulation valve further comprises a biasing member disposed in the throughbore of the housing between an annular shoulder of the sliding sleeve and an annular shoulder of the housing, wherein the biasing member is configured to exert a biasing force against the sliding sleeve. In certain embodiments, the sliding sleeve further comprises a second radial port configured to provide fluid communication between the throughbore of the sliding sleeve and a first annular shoulder of the sliding sleeve, and a plurality of circumferentially spaced slots extending radially into an outer surface of the sliding sleeve, wherein the slots are configured to provide fluid communication between a second annular shoulder of the sliding sleeve and the throughbore of the housing.

An embodiment of a method of controlling fluid flow through a circulation valve disposed in a borehole comprises flowing a fluid at a first flowrate through a first jet and a second jet disposed in a throughbore of a sliding sleeve disposed in a housing of the circulation valve, flowing the fluid at a second flowrate through the first jet and the second jet to actuate the sliding sleeve from a first position to a second position, and flowing the fluid from the throughbore of the sliding sleeve through a housing port of the housing in response to actuating the sliding sleeve from the first position to a second position. In some embodiments, the method further comprises producing a first pressure drop in the fluid flow as the fluid passes through the first jet, and producing a second pressure drop in the fluid flow as the fluid passes through the second jet. In certain embodiments, the circulation valve further comprises producing a pressure force on the sliding sleeve to actuate the sliding sleeve from the first position to the second position in response to producing the first pressure drop and the second pressure drop in the fluid flow. In certain embodiments, the first pressure drop is greater than the second pressure drop.

BRIEF DESCRIPTION OF THE DRAWINGS

For a detailed description of the various exemplary embodiments disclosed herein, reference will now be made to the accompanying drawings in which.

DETAILED DESCRIPTION OF EXEMPLARY EMBODIMENTS

Figure 1:
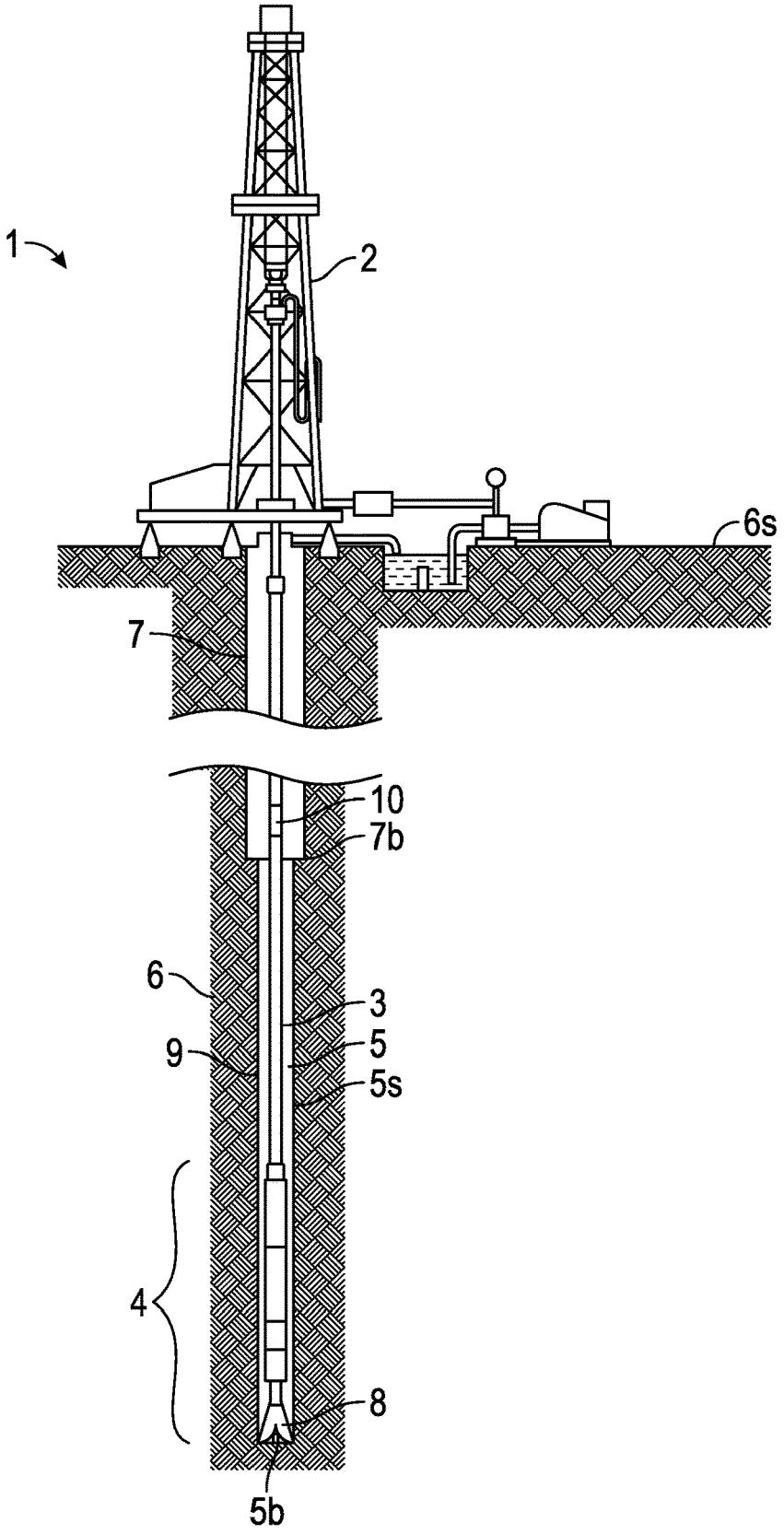
FIG. 1 is a schematic view of an embodiment of a drilling system in accordance with principles disclosed herein.

The following discussion is directed to various embodiments of the disclosure. One skilled in the art will understand that the following description has broad application, and the discussion of any embodiment is meant only to be exemplary of that embodiment, and not intended to intimate that the scope of the disclosure, including the claims, is limited to that embodiment.

The drawing figures are not necessarily to scale. Certain features of the disclosure may be shown exaggerated in scale or in somewhat schematic form, and some details of conventional elements may not be shown, all in the interest of clarity and conciseness. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Referring now to FIG. 1, a downhole drilling system 1 comprises a rig 2, a drill string 3 having a bottom hole assembly (BHA) 4 coupled to a lower end thereof. Drill string 3 extends through a wellbore 5 drilled into a subterranean formation 6. In the embodiment shown in FIG. 1, wellbore 5 includes surface casing 7 extending downwards from the surface. BHA 4 generally includes components of the drill string 3 for drilling the wellbore 5. Particularly, the BHA 4 includes a drill bit 8 that engages the formation 6 and other components for powering and orienting the drill bit 8, such as a mud motor, drill collars, stabilizers, and the like. Drilling fluid or mud is pumped down the drill string 3 and through the downhole motor of BHA 20, eventually passing out of the drill bit 8 through nozzles positioned in the bit face. The drilling fluid cools the drill bit 8 and flushes cuttings away from the face of drill bit 8. The drilling fluid and cuttings are forced from the bottom 5*b* of the wellbore 5 to the surface 6*s* through an annulus 9 formed between the drill string 3 and the wellbore sidewall 5*s*.

In the embodiment shown in FIG. 1, the annulus 9 of the portion of the wellbore 5 disposed in surface casing 7 has a larger cross-sectional area than the annulus 9 of the portion of wellbore 5 disposed between a lower end or bottom 7*b* of surface casing 7 and the bottom 5*b* of wellbore 5. Further, in this embodiment drill string 3 comprises an annulus boost or circulation valve 10 disposed in the portion of wellbore 5 surrounded by surface casing 7. Although drill string 3 is illustrated as having a circulation valve 10 disposed within surface casing 7, in other embodiments drill string 3 may comprise a circulation valve 10 disposed near BHA 4, or multiple circulation valves 10 disposed at different intervals along drill string 3. Circulation valve 10 is configured to selectably divert fluid from an internal bore of drill string 3 to the annulus 9. In some embodiments, circulation valve 10 of drill string 3 is configured to boost the velocity of fluid flowing through the annulus 9 of wellbore 5. Particularly, in certain embodiments circulation valve 10 is configured to prevent the fluid flow through the annulus 9 from dropping below a slip velocity as the cross-sectional area of wellbore 5 decreases moving from the bottom 5*b* of wellbore 5 towards the surface 6*s*.

Figure 2:
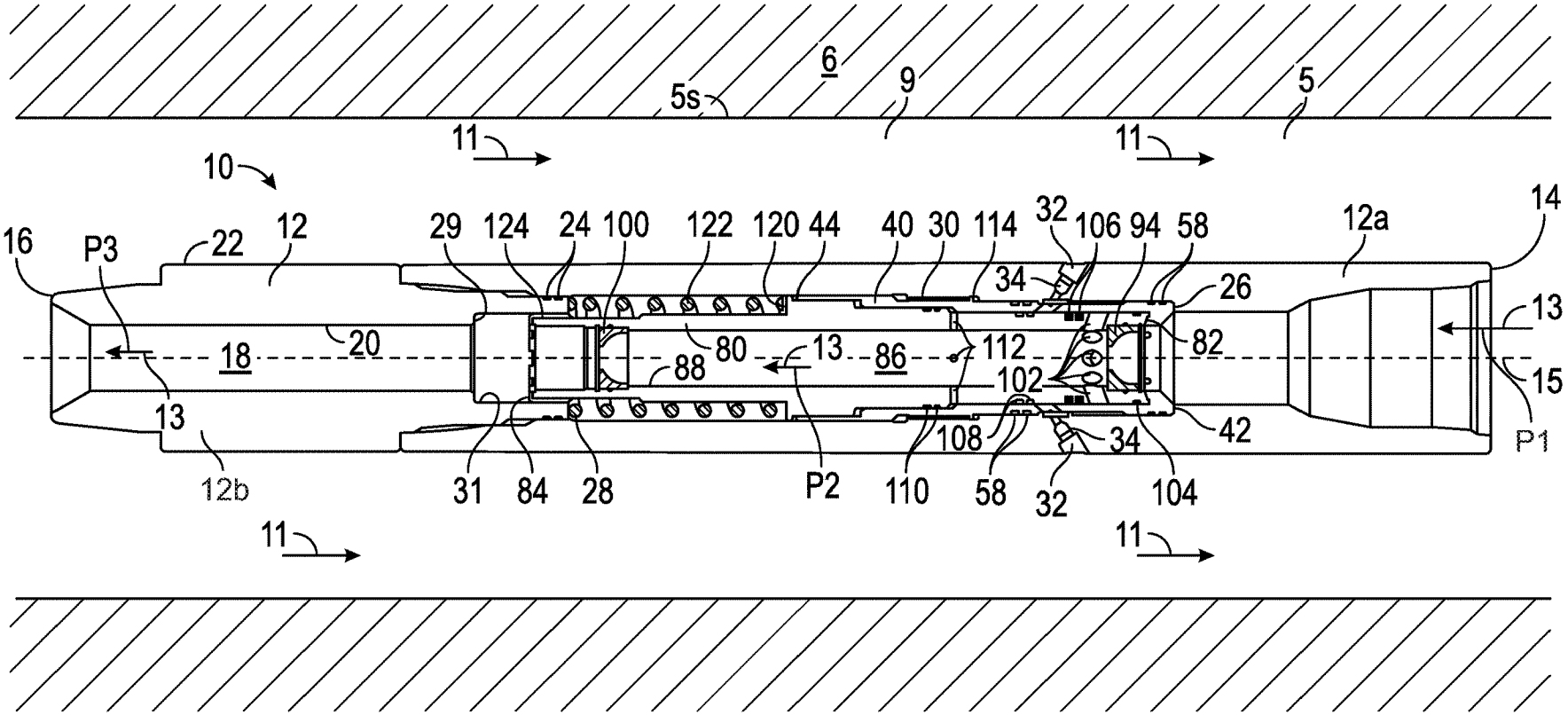
FIG. 2 illustrates a side cross-sectional view of an embodiment of a circulation valve of the drilling system of FIG. 1 in a first position in accordance with principles disclosed herein.

Referring to FIG. 2, an embodiment of circulation valve 10 of drilling system 1 is shown. Particularly, FIG. 2 illustrates circulation valve 10 in a first or closed position. In the embodiment shown in FIG. 2, circulation valve 10 has a central or longitudinal axis 15 and generally includes an outer housing 12, a valve sleeve 40, and a sliding sleeve 80, where valve sleeve 40 and sliding sleeve 80 are disposed within a throughbore 18 of the housing 12. In this embodiment, circulation valve 10 is generally configured to provide selectable fluid communication between throughbore 18 of housing 12 and annulus 9. Circulation valve 10 is further configured to selectably increase or adjust the annular velocity (AV) of fluid flowing through the annulus 9 along an annular flowpath 11.

Housing 12 of circulation valve 10 is generally tubular and includes a first or upper box end 14 and a second or lower pin end 16. Throughbore 18 of housing 12 extends between upper end 14 and lower end 16 and is defined by a generally cylindrical inner surface 20. Both upper end 14 and lower end 16 of housing 12 are equipped with threaded couplers for forming threaded connections with adjoining tubular members (not shown). Housing 12 also includes a generally cylindrical outer surface 22, where annulus 9 extends radially between the wellbore sidewall 5*s* and outer surface 22 of housing 12. Further, housing 12 comprises a first or upper tubular section 12*a* and a second or lower tubular section 12*b* coupled to upper section 12*a* via a threaded connection or joint disposed therebetween. Fluid communication between annulus 9 and throughbore 18 is restricted by an annular seal 24 disposed radially between lower tubular section 12*b* and upper tubular section 12*a*. Although in the embodiment shown in FIG. 2 housing 12 includes upper and lower sections 12*a* and 12*b*, in other embodiments, housing 12 may comprise a single, unitary tubular member.

In this embodiment, the inner surface 20 of housing 12 includes an upper annular shoulder 26 facing lower end 16 and a first lower annular shoulder 28 facing upper end 14 and axially spaced from upper shoulder 26. Inner surface 20 of housing 12 also includes a second lower annular shoulder 29 facing upper end 14 and disposed axially between first lower shoulder 28 and lower end 16. First lower shoulder 28 and second lower shoulder 29 define the axial ends of a reduced diameter segment 31 of the inner surface 20 of housing 12, which receives a lower end of sliding sleeve 80. In addition, housing 12 further includes a plurality of circumferentially spaced radial or housing ports 32 disposed between upper shoulder 26 and lower shoulder 28 and extending obliquely between inner surface 20 and outer surface 22. Particularly, ports 32 of housing 12 are angled uphole such that an acute angle is formed between each port 32 and the annular flowpath 11. However, although in the embodiment shown in FIG. 2 ports 32 are angled uphole, in other embodiments ports 32 may be angled in other directions with respect to annulus 9.

In the embodiment shown in FIG. 2, each port 32 includes a jet 34 configured to produce a flow restriction or pressure differential on fluid flowing therethrough. Jets 34 are releasably coupled to housing 12, and thus, may be removed and replaced from housing 12 and circulation valve 10. As will be discussed further herein, the flow restriction provided by jets 34 in ports 32 may be adjusted depending upon operating conditions and preferred flow distribution. For instance, jets 34 may be adjusted to provide a preferred distribution of fluid flow through circulation valve 10 when circulation valve is actuated into a second or open position. Particularly, jets 34 may be adjusted to determine the portion of fluid flow entering throughbore 18 at upper end 14 that flows into the annulus 9 via ports 32, and the portion of fluid flow entering throughbore 18 at upper end 14 that exits throughbore 18 at lower end 16 and continues to flow through the drill string 3 (not shown) coupled with circulation valve 10.

Figure 3:
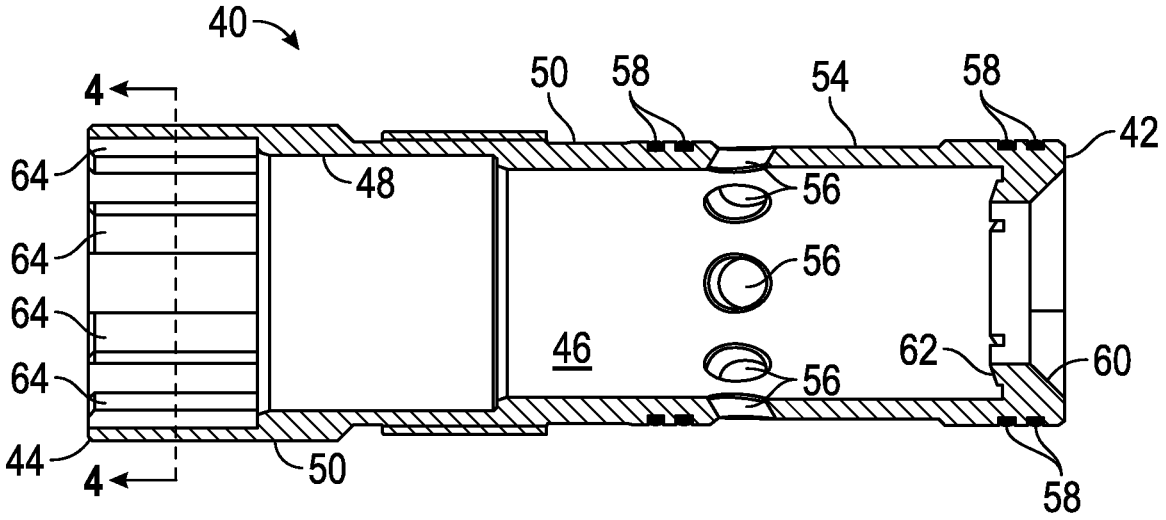
FIG. 3 is a side cross-sectional view of an embodiment of a valve sleeve of the circulation valve shown in FIG. 2 in accordance with principles disclosed herein.
Figure 4:
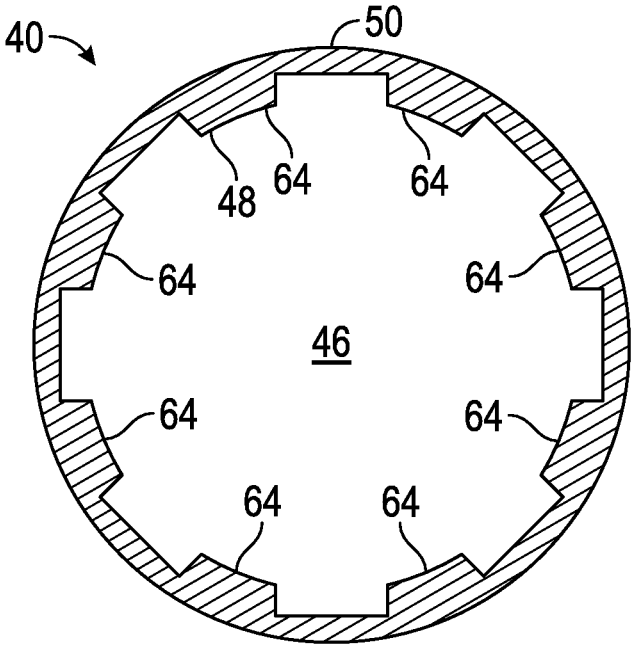
FIG. 4 is a cross-sectional view along line 4-4 of FIG. 3 of the valve sleeve shown in FIG. 5.
Figure 5:
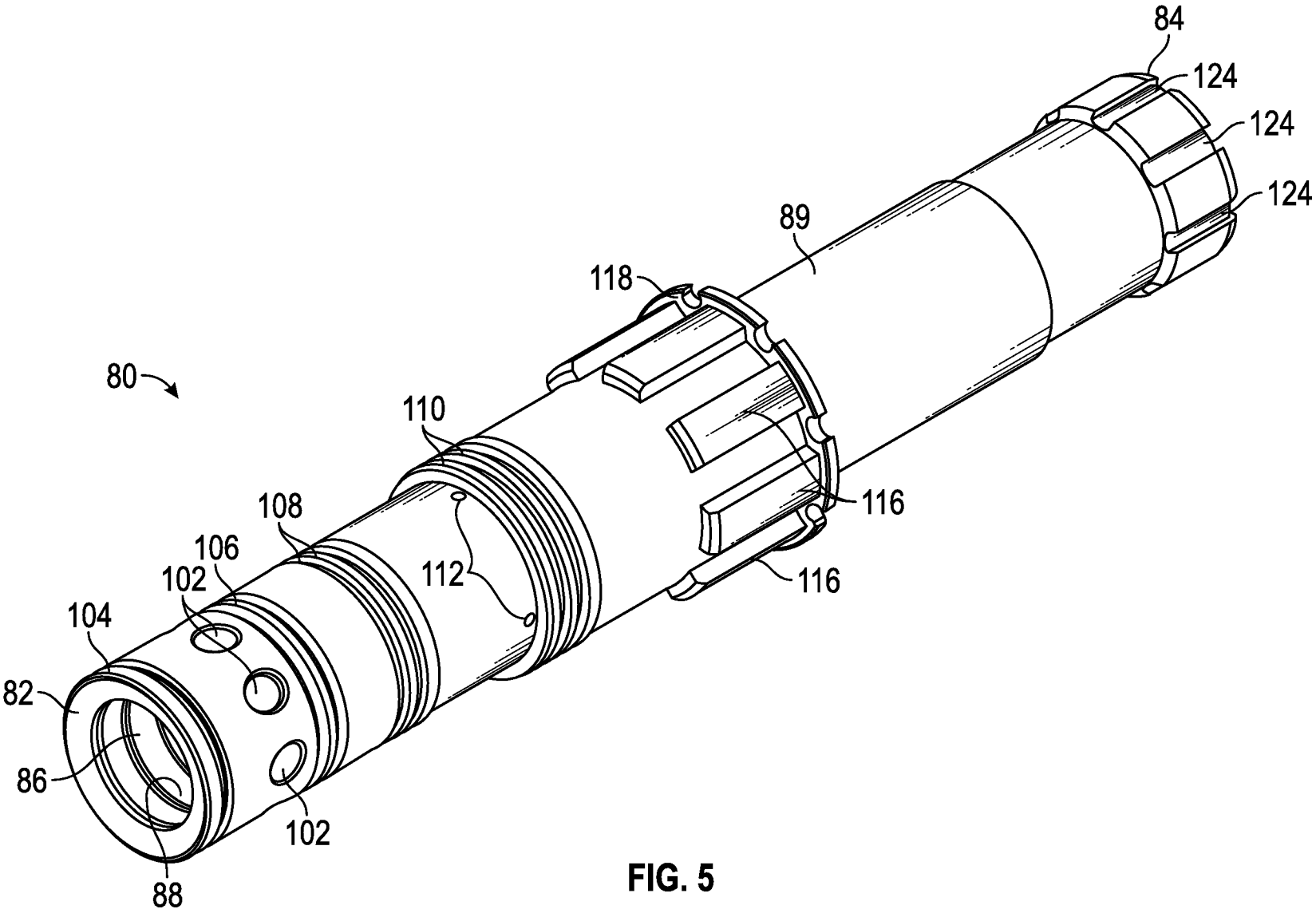
FIG. 5 is a perspective view of an embodiment of a sliding sleeve of the circulation valve shown in FIG. 2 in accordance with principles disclosed herein.
Figure 6:
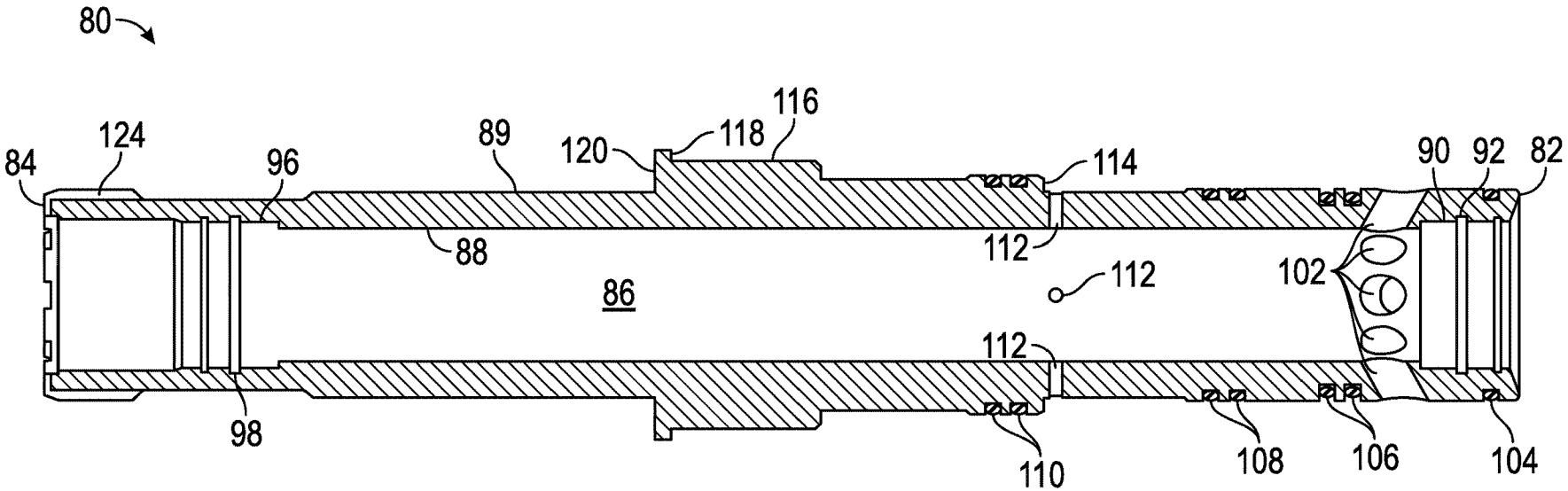
FIG. 6 is a side cross-sectional view of the sliding sleeve shown in FIG. 5.
Figure 7:
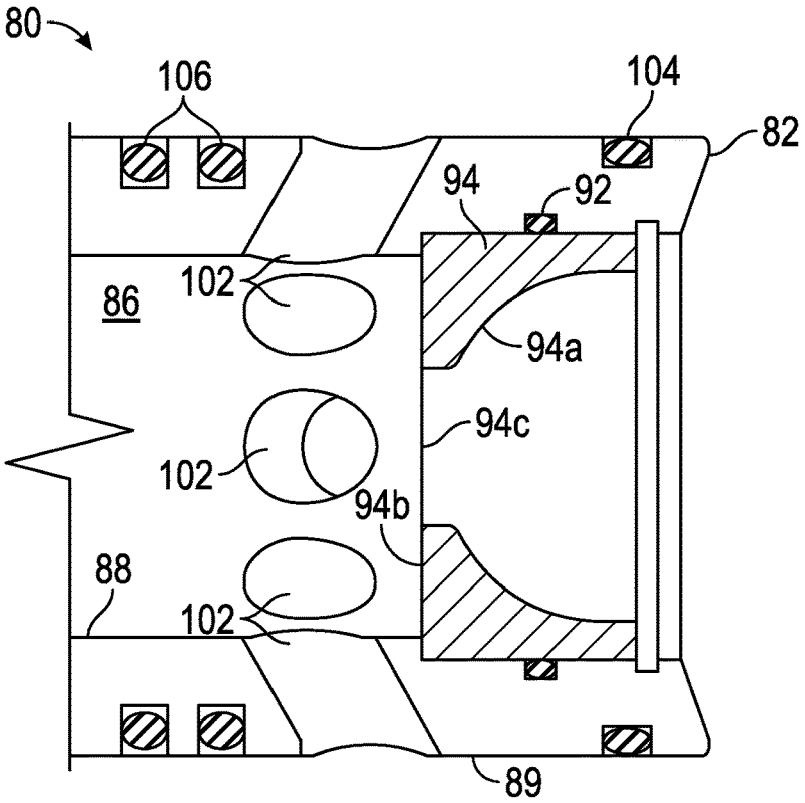
FIG. 7 is a zoomed-in side cross-sectional view of an embodiment of a first jet of the sliding sleeve shown in FIG. 5 in accordance with principles disclosed herein.

Referring to FIGS. 2-4, valve sleeve 40 of circulation valve 10 is generally tubular and includes a first or upper end 42, a second or lower end 44, and a throughbore 46 extending between ends 42 and 44. In this arrangement, throughbore 46 of valve sleeve 40 is defined by a generally cylindrical inner surface 48. Valve sleeve 40 is disposed in throughbore 18 of housing 12 between upper shoulder 26 and lower shoulder 28, with upper end 42 of valve sleeve 40 in engagement or disposed directly adjacent upper shoulder 26. Valve sleeve 40 also includes a generally cylindrical outer surface 50 having a female threaded connector disposed thereon configured to threadably couple with a corresponding threaded coupler disposed on the inner surface 20 of housing 12, forming a threaded connection 30 (shown in FIG. 2) therebetween to axially and rotationally lock valve sleeve 40 to housing 12 of circulation valve 10.

In the embodiment shown in FIGS. 2-4, outer surface 50 of valve sleeve 40 includes an annular groove 54 extending therein and disposed proximal upper end 42. Annular groove 54 is in fluid communication with a plurality of circumferentially spaced radial ports 56 extending obliquely between inner surface 48 and outer surface 50 of valve sleeve 40. Particularly, ports 56 of valve sleeve 40 are angled uphole with respect to annulus 9. However, although in the embodiment shown in FIG. 2 ports 56 are angled uphole, in other embodiments ports 56 may be angled in other directions with respect to annulus 9. In this embodiment, annular groove 54 of valve sleeve 40 is in fluid communication with ports 32 of housing 12, thereby providing a path of fluid communication between ports 56 of valve sleeve 40 and ports 32 of housing 12 irrespective of the relative angular orientation of valve sleeve 40 relative housing 12. Additionally, valve sleeve 40 includes a pair of axially spaced annular seals or seal assemblies 58 disposed in corresponding annular grooves extending into the outer surface 50 of valve sleeve 40. Particularly, one pair of annular seals 58 is disposed proximal each axial end of annular groove 54. Annular seals 58 of valve sleeve 40 fluidically isolate annular groove 54 from the rest of throughbore 18, restricting fluid flow between annular groove 54 of valve sleeve 40 and throughbore 18 of housing 12.

In the embodiment shown in FIGS. 2-4, the inner surface 48 of valve sleeve 40 includes a chamfered surface 60 at upper end 42 for directing a fluid flow into throughbore 46. Additionally, inner surface 48 of valve sleeve 40 includes an annular upper shoulder 62 disposed proximal upper end 42 and facing the lower end 44 of valve sleeve 40. Upper shoulder 62 of valve sleeve 40 is configured to restrict or delimit relative axial movement between valve sleeve 40 and sliding sleeve 80. Particularly, upper shoulder 62 of valve sleeve 40 is configured to delimit the maximum upward (i.e., in the direction of upper end 42 of valve sleeve 40) position of sliding sleeve 80 respective valve sleeve 40 and housing 12. As shown particularly in FIG. 2, when circulation valve 10 is in the closed position the upper shoulder 62 of valve sleeve 40 is disposed directly adjacent or physically engages an end of sliding sleeve 80. Further, the inner surface 48 of valve sleeve 40 includes a plurality of circumferentially spaced keys 64 that extend axially from lower end 44. As will be discussed further herein, keys 64 are configured to physically engage a corresponding set of keys of sliding sleeve 80 to restrict relative rotation between valve sleeve 40 and sliding sleeve 80. Although in the embodiment of FIGS. 2-4 circulation valve 10 is shown including valve sleeve 40, in other embodiments, circulation valve 10 may not include valve sleeve 40. For instance, in some embodiments, valve sleeve 40 may be incorporated into housing 12 as a single, unitary member.

Referring to FIGS. 2 and 5-8, sliding sleeve 80 of circulation valve 10 is generally tubular and includes a first or upper end 82, a second or lower end 84, and a throughbore 86 extending between upper end 82 and lower end 84. In this arrangement, throughbore 86 of sliding sleeve 80 is defined by a generally cylindrical inner surface 88. Sliding sleeve 80 is disposed in both throughbore 46 of valve sleeve 40 and throughbore 18 of housing 12, with lower end 84 received within reduce diameter segment 31 of the inner surface 20 of housing 12. Particularly, when circulation valve 10 is in the closed position shown in FIG. 2, sliding sleeve 80 is disposed in a first or upper position with upper end 82 in engagement with or disposed directly adjacent upper shoulder 62 of valve sleeve 40 and lower end 84 disposed distal or axially spaced from second lower shoulder 29 of housing 12. In the second or open position shown in FIG. 9, sliding sleeve 80 is disposed in a second or lower position with upper end 84 disposed distal upper shoulder 62 of valve sleeve 40 and lower end 84 in engagement with or disposed directly adjacent second lower shoulder 29.

The inner surface 88 of sliding sleeve 80 includes a first or upper seat 90 disposed at upper end 82. Upper seat 90 of inner surface 88 includes an annular seal 92 extending therein and receives a first or upper jet or flow restriction 94 therein, where upper jet 94 is axially locked to sliding sleeve 80 via an annular retainer disposed in upper seat 90. In this arrangement, upper jet 94 is releasably coupled to upper seat 90 such that upper jet 94 may be removed and replaced from sliding sleeve 80. Annular seal 92 of upper seat 90 acts to restrict fluid flow around jet 94 that is passing into throughbore 88 of sliding sleeve 80 from upper end 82. Upper jet 94 is configured to produce a flow restriction or pressure differential on fluid flowing therethrough, and includes a generally hemispherical upper surface 94*a*, a lower annular surface 94*b*, and an aperture 94*c* (each shown in FIG. 7) extending therethrough, where aperture 94*c* is disposed concentric with longitudinal axis 15.

The inner surface 88 of sliding sleeve 80 also includes a second or lower seat 96 disposed proximal lower end 84 of sleeve 80, axially spaced from upper seat 94. Lower seat 96 of inner surface 88 includes an annular seal 98 extending therein and receives a second or lower jet or flow restriction 100 therein, where lower jet 100 is axially locked to sliding sleeve 80 via an annular retainer of lower seat 96. In this arrangement, lower jet 100 is releasably coupled to lower seat 96, allowing lower jet 100 to be removed and replaced from sliding sleeve 80. Annular seal 98 of lower seat 96 acts to restrict fluid flow around jet 100 that is passing out of throughbore 88 via the lower end 84 of sliding sleeve 80. Lower jet 100 is configured to produce a flow restriction or pressure differential on fluid flowing therethrough, and includes a generally hemispherical upper surface 100*a*, a lower annular surface 100*b*, and an aperture 100*c* (each shown in FIG. 8) extending therethrough, which is disposed concentric with longitudinal axis 15.

In the embodiment shown in FIGS. 2 and 5-8, upper jet 94 and lower jet 100, and particularly the aperture 94*c* of upper jet 94 and the aperture 100*c* of lower jet 100, may be adjusted depending upon operating conditions. Particularly, upper jet 94 and lower jet 100 may be adjusted depending upon the flowrate of the fluid flow along a drillstring flowpath 13 shown in FIG. 2. Particularly, drillstring flowpath 13 comprises fluid pumped through drill string 3 to circulation valve 10, where fluid of flowpath 13 enters throughbore 18 of housing 12 at upper end 14 and exits throughbore 18 at lower end 16.

In some embodiments, jets 94 and 100 are configured to generate a sufficient pressure differential at operational flow rates across their respective apertures 94*c* and 100*c*, respectively, to shift circulation valve 10 from the closed position shown in FIG. 2 to a second or open position shown in FIG. 9, as will be explained further herein. Further, jets 94 and 100 are configured to provide a sufficient pressure differential at operational flow rates to shift circulation valve 10 to the open position while providing sufficient clearance for the passage of tools and/or equipment (e.g., coiled tubing, etc.) through circulation valve 10, including apertures 94*c* and 100*c*, of jets 94 and 100. Depending on operational parameters, jets 94 and 100 may be removed and replaced from sliding sleeve 80 with other jets or obturating devices. For instance, jets 94 and 100 may be replaced with other jets comprising apertures of a different diameter than the diameter of apertures 94*c* and 100 of jets 94 and 100. In some embodiments, jets comprising apertures of relatively larger diameters may be used in applications where relatively large tools are conveyed through the throughbore 18 of circulation valve 10. In other embodiments, jets comprising apertures of relatively smaller diameters may be used in applications comprising limited flow rates requiring a larger pressure differential or drop across the jets of sliding sleeve 80.

In the embodiment shown in FIGS. 2 and 5-8, sliding sleeve 80 of circulation valve 10 also includes a plurality of circumferentially spaced first or upper radial upper ports 102 disposed proximal upper end 82 but axially below upper seat 90, where upper ports 102 extend obliquely between inner surface 88 and a generally cylindrical outer surface 89 of sliding sleeve 80. Particularly, upper ports 102 of sliding sleeve 80 are angled uphole such that an acute angle is formed between each port 102 and the annular flowpath 11. However, although in this embodiment upper ports 102 are angled uphole, in other embodiments upper ports 102 may be angled in other directions with respect to annulus 9. Upper ports 102 are configured to provide for fluid communication between throughbore 86 of sliding sleeve 80 and ports 56 of valve sleeve 40 when circulation valve 10 is in the open position shown in FIG. 9.

Additionally, the outer surface 89 of sliding sleeve 80 includes a plurality of axially spaced annular seals disposed therein: an upper annular seal 104 disposed axially between upper end 82 of sliding sleeve 80 and upper ports 102, and a first intermediate annular seal 106 disposed adjacent upper ports 102. In this arrangement, upper seal 104 and first intermediate seals 106 axially flank upper ports 102, restricting fluid communication between upper ports 102 of sliding sleeve 80 and ports 56 of valve sleeve 40 when circulation valve 10 is disposed in the closed position shown in FIG. 2. Outer surface 89 of sliding sleeve 80 further includes a second intermediate annular seal 108, and a lower annular seal 110. Second intermediate annular seal 108 and lower annular seal 110 are axially spaced along outer surface 89 of sliding sleeve 80. Particularly, a plurality of circumferentially spaced and radially extending second or lower ports 112 are disposed axially between seals 108 and 110. In this arrangement, fluid communication between either upper ports 102 of sliding sleeve 80 or ports 56 of valve sleeve 40 and lower ports 112 of sleeve 80 is restricted via seals 108 and 110. Additionally, outer surface 89 of sliding sleeve 80 includes a first or upper annular shoulder 114 extending radially outwards therefrom, where upper shoulder 114 is disposed axially between seals 108 and 110.

In the embodiment shown in FIGS. 2 and 5-8, the outer surface 89 of sliding sleeve 80 additionally includes a plurality of circumferentially spaced keys 116, an intermediate annular shoulder 118, and a lower annular shoulder 120 axially spaced from intermediate shoulder 118. In this arrangement, shoulders 116 and 120 are each axially disposed between lower annular seal 110 and the lower end 84 of sliding sleeve 80. Further, shoulder 118 faces upper end 82 of sliding sleeve 80 while lower annular shoulder 120 faces the lower end 84. Keys 116 of sliding sleeve 80 are configured to matingly engage the keys 64 of valve sleeve 40 to thereby restrict relative rotation between sliding sleeve 80 and valve sleeve 40. A biasing member 122 is disposed about sliding sleeve 80 and extends axially between lower shoulder 28 of housing 12 and lower shoulder 120 of sliding sleeve 80. In this arrangement, biasing member 122 acts against annular shoulder 120 of sliding sleeve 80 to upwardly bias sliding sleeve 80 such that upper end 82 of sliding sleeve 80 engages annular upper shoulder 62 of valve sleeve 40. In other words, biasing member 122 acts to bias circulation valve 10 into the closed position shown in FIG. 2. In addition, the outer surface 89 of sliding sleeve 80 includes a plurality of circumferentially spaced slots 124 extending radially therein. In this embodiment, slots 124 extend axially from the lower end 84 of sliding sleeve 80 and are configured to facilitate fluid communication between the portion of throughbore 18 of housing 12 defined by reduced diameter segment 31 and the lower annular shoulder 120 of sliding sleeve 80, as will be discussed further herein.

Figure 9:
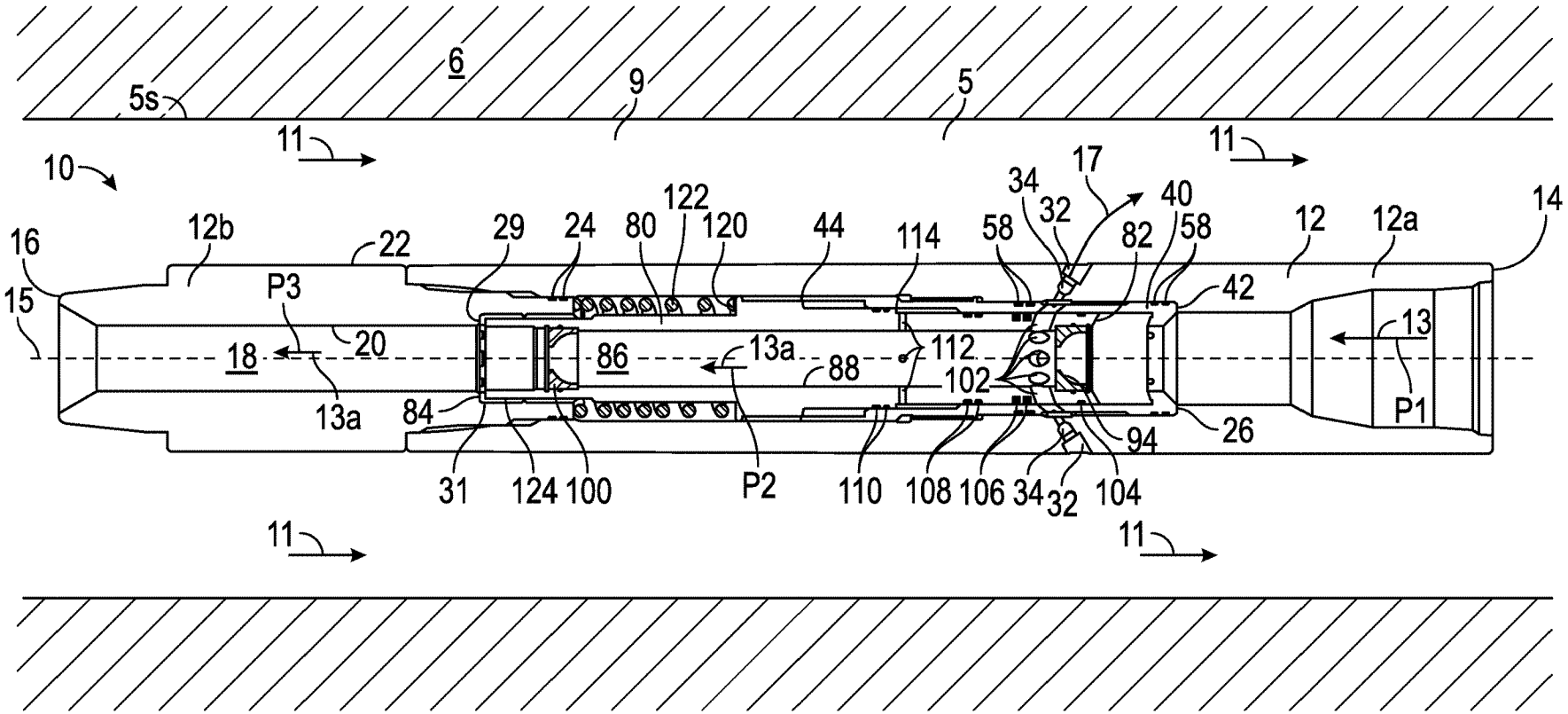
FIG. 9 illustrates a side cross-sectional view of the circulation valve of FIG. 2 in a second position in accordance with principles disclosed herein.

Referring to FIGS. 2 and 9, circulation valve 10 is configured to actuate between the closed position shown in FIG. 2 and the open position shown in FIG. 9 in response to changes in fluid flow rate of the drill string flowpath 13. Thus, in this embodiment circulation valve 10 is configured to actuate between the closed and open positions without the need of an external obturating member inputted to throughbore 18 of housing 12 or a "j-slot" or indexing mechanism. Specifically, under static conditions, where there is zero or an insignificant amount of fluid flow along drillstring fluid flowpath 13, the fluid pressure within circulation valve 10 is largely homogenous. In this environment, the biasing force applied against sliding sleeve 80 by biasing member 122 forces circulation valve 10 into the closed position shown in FIG. 2 where fluid flow between throughbore 86 of sliding sleeve 80 and the annulus 9 is restricted. However, increased fluid flow along drillstring flowpath 13 imparts a pressure force against sliding sleeve 80 in the direction of lower end 16 of housing 12 sufficient to shift circulation valve 10 into the open position shown in FIG. 9, where lower end 84 of sliding sleeve 80 engages second lower shoulder 29 of housing 12 and fluid flow is permitted between throughbore 86 of sliding sleeve 80 and the annulus 9.

As described above, upper jet 94 and lower jet 100 of sliding sleeve 80 are each configured to provide a pressure differential or drop on a fluid flow passing therethrough. Specifically, under dynamic conditions, where there is a substantial or first operating fluid flow rate along drillstring flowpath 13, fluid flowing along flowpath 13 is disposed at different fluid pressures. In this environment, with fluid flowing along drill string flowpath 13 at the first operating flow rate, fluid flowing along drillstring flowpath 13 prior to flowing through the aperture 94*c* (shown in FIG. 7) of upper jet 94 is substantially disposed at a first fluid pressure P1. Additionally, fluid that has passed through aperture 94*c* of upper jet 94, but has yet to flow through aperture 100*c* (shown in FIG. 8) of lower jet 100*a*, is substantially disposed at a second fluid pressure P2, where the second fluid pressure P2 is less than the first fluid pressure P1. In other words, fluid flowing along drill string flowpath 13 at the first operating fluid flow rate experiences a first pressure drop defined by the difference in fluid pressure between P1 and P2 as the fluid flows through aperture 94*c* of upper jet 94. Further, fluid that has passed through both aperture 94*c* of upper jet 94 and aperture 100*c* of lower jet 100 is substantially disposed at a third fluid pressure P3, where third pressure P3 is less than either second pressure P2 or first pressure P1. In other words, fluid flowing along drill string flowpath 13 at the first operating fluid flow rate experiences a second pressure drop defined by the difference in fluid pressure between P2 and P3 as the fluid flows through aperture 100*c* of lower jet 100.

The pressure differential or drop defined by the difference in pressures P1 and P3 of fluid flowing along drill string flowpath 13 at the first operating flow rate exerts a pressure force against sliding sleeve 80 in a downwards direction (i.e., the direction of the second end 16 of housing 12). Particularly, the portion of fluid flowing along drill string flowpath 13 disposed at first pressure P1 acts against the upper end 82 of sliding sleeve 80 in the downwards direction, where the upper end 82 of sliding sleeve 80 comprises an upper annular pressure surface. Fluid disposed at first pressure P1 also acts against sliding sleeve 80 in the downwards direction at the hemispherical surface 94*a* of upper jet 94. Additionally, the portion of fluid flowing along flowpath 13 disposed at third pressure P3 exerts a pressure force on sliding sleeve 80 in an upwards direction (i.e., in the direction of the upper end 14 of housing 12) at the lower end 84 of sliding sleeve 80 and lower shoulder 120 via slots 124 in the outer surface 89 of sleeve 80. In some embodiments, fluid disposed at third pressure P3 applies a pressure force against sliding sleeve 80 in the downwards direction at intermediate shoulder 118 and the upper ends of keys 116. However, in this embodiment lower shoulder 120 comprises a larger surface area than intermediate shoulder 118 and the upper end of keys 116 combined, resolving the pressure forces applied at third pressure P3 against shoulders 118, 120, and keys 116 into a single net pressure force against sliding sleeve 80 in the upwards direction at lower shoulder 120.

Figure 8:
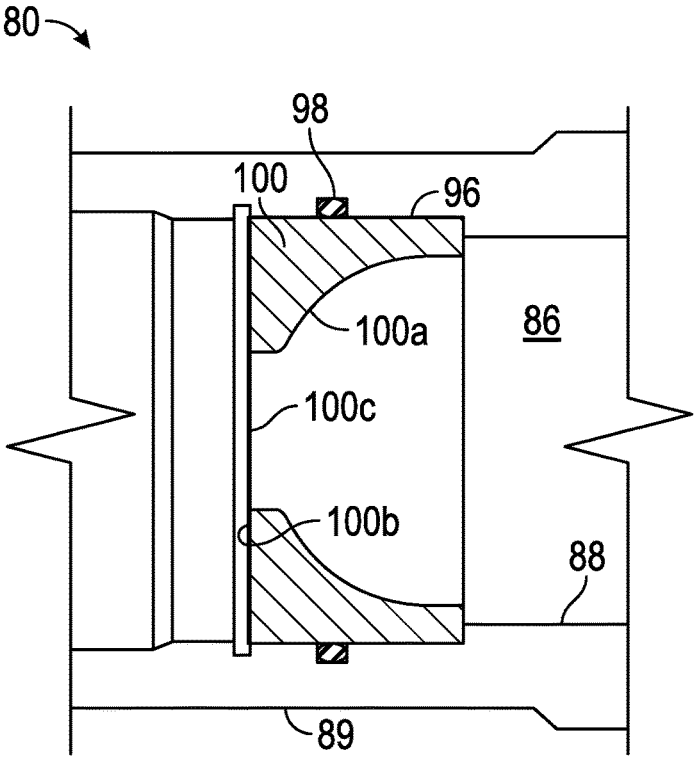
FIG. 8 is a zoomed-in side cross-sectional view of an embodiment of a second jet of the sliding sleeve shown in FIG. 5 in accordance with principles disclosed herein.

Additionally, fluid disposed at third pressure P3 exerts an upwards pressure force on sliding sleeve 80 at the lower surface 100*b* of lower jet 100 (shown in FIG. 8). Further, the portion of fluid flowing along flowpath 13 disposed at second pressure P2 exerts a pressure force on sliding sleeve 80 in the downwards direction at upper annular shoulder 114 via lower ports 112. In addition, fluid disposed at second pressure P2 exerts an upwards pressure force on sliding sleeve 80 at the lower surface 94*b* of upper jet 94 (shown in FIG. 7). Given that first pressure P1 is greater than second pressure P2 and third pressure P3, and second pressure P2 is greater than third pressure P3, the net pressure force applied to sliding sleeve 80 by fluid flowing along drill string flowpath 13 is in the downwards direction. In other words, a first pressure drop P1-P2 produced by upper jet 94 and a second pressure drop P2-P3 produced by lower jet 100 each apply a downwards net pressure force on sliding sleeve 80. In some embodiments, the first pressure drop P1-P2 is greater than the second pressure drop P2-P3. However, when fluid is flowing along drill string flowpath 13 at the first operating flow rate, the pressure force exerted on sliding sleeve 80 is less than the biasing force applied against sleeve 80 by biasing member 122, and thus, circulation valve 10 is held in the closed position shown in FIG. 2 when fluid flow along flowpath 13 is at the first operating flow rate.

In the embodiment of FIGS. 2 and 9, circulation valve 10 may be actuated into the open position by increasing the flow rate of fluid flowing along drill string flowpath 13 from the first operating flow rate to a second operating flow rate, which is greater than the first operating flow rate. As the rate of fluid flow along drill string flowpath 13 is increased, the pressure differentials P1-P2 (i.e., the first pressure drop) and P2-P3 (i.e., the second pressure drop) are correspondingly increased, thereby increasing the downwards pressure force applied to sliding sleeve 80. Once the flow rate increases to a trigger or actuation flow rate, the downwards net pressure force applied to sliding sleeve 80 becomes greater than the biasing force applied to sleeve 80 in the upwards direction by biasing member 122, causing sliding sleeve 80 to begin travelling from the upper position shown in FIG. 2 towards the lower position shown in FIG. 9. As the sliding sleeve 80 is displaced towards the lower position shown in FIG. 9, upper ports 102 of sliding sleeve 80 align with the ports 56 of valve sleeve 40 and radial ports 32 of housing 12, establishing a radially extending fluid flowpath 17 (shown in FIG. 9) that extends between throughbore 86 of sliding sleeve 80 and annulus 9.

In this manner, a first or annulus portion of the fluid flowing along drill string flowpath 13 is diverted to the annulus 9 and annular flowpath 11 via radial flowpath 17, while a second or drillstring portion 13*a* of drill string flowpath 13 continues to flow through throughbore 18 of housing 12, and exits circulation valve 10 via the lower end 16 of housing 12. The addition of fluid from the drillstring flowpath 13 to the annular flowpath 11 via radially extending flowpath 17 results in an increase or boosting of the fluid flowrate along annular flowpath 11. The increase in fluid flowrate along annular flowpath 11 may prevent the fluid flowing along annular flowpath 11 from dropping below the fluid's slip velocity, and in turn, may prevent drill cuttings entrained in the annular flowpath 11 from settling. In this embodiment, when sliding sleeve 80 is disposed in the upper position and circulation valve 10 is disposed in the closed position, fluid is restricted from flowing between the throughbore 18 of housing 12 and the annulus 9, and thus, the substantial entirety of the fluid comprising drill string flowpath 13 entering throughbore 18 via upper end 14 exits housing 12 via lower end 16.

When radial flowpath 17 is established and the annulus portion of drill string flowpath 13 is diverted to the annulus 9, second pressure P2 and third pressure P3 are reduced, thereby reducing the second pressure drop P2-P3. The reduction in second pressure drop P2-P3 caused by flow along radial flowpath 17 correspondingly reduces the downwards net pressure force applied to sliding sleeve 80. Thus, fluid flow along drill string flowpath 13 must be additionally increased to the second operating flow rate, which is greater than the actuation flow rate. As the flow rate is increased to the second operating flow rate, the sliding sleeve 80 is fully actuated into the lower position where second end 84 engages or is disposed directly adjacent shoulder lower shoulder 29 of housing 12, placing circulation valve 10 into the open position. Additionally, the downwards net pressure force applied to sliding sleeve 80 at the second operating flow rate is sufficient to hold sliding sleeve 80 in the lower position, thus retaining circulation valve 10 in the open position. Circulation valve 10 may be actuated into the closed position from the open position by reducing the flow rate of fluid flowing along drill string flowpath 13 from the second operating flow rate to the first operating flow rate, which reduces the downwards net pressure force applied to sliding sleeve 80 to a degree sufficient to allow biasing member 122 to displace sliding sleeve upwards into the upper position. Further, the additional pressure forces applied to sliding sleeve 80 by upper annular shoulder 114 (downwards at second pressure P2) and lower annular shoulder 120 (upwards at third pressure P3) assist in accelerating the actuation of sliding sleeve 80 between the upper and lower positions.

As described briefly above, when circulation valve 10 is in the open position shown in FIG. 9, the first portion of the fluid flow entering circulation valve 10 from drillstring flowpath 13 is diverted to the annular flowpath 11 via radially extending flowpath 17, while the remaining or second portion 13*a* of fluid continues to flow along drillstring flowpath 13, and exits circulation valve 10 at lower end 16 of housing 12. The portion of fluid entering circulation valve 10 from drillstring flowpath 13 that is diverted to annular flowpath 11 may be adjusted by altering the performance characteristics of jets 34 disposed in ports 32 of housing 12. Particularly, if it is desired to direct a greater portion of the fluid flow entering circulation valve 10 to the annular flowpath 11 (i.e., increase the first portion flowing along radial flowpath 17 and decrease the second portion 13*a*), jets 34 may be selected having a relatively lower pressure drop across their respective apertures (e.g., apertures having relatively greater flow area), such that jets 34 create a relatively lesser flow restriction through ports 32 of housing 12. Similarly, if it is desired to direct a lesser portion of the fluid flow entering circulation valve 10 to the annular flowpath 11 (i.e., decrease the first portion flowing along radial flowpath 17 and increase the second portion 13*a*), jets 34 may be selected having a relatively greater pressure drop across their respective apertures (e.g., apertures having relatively less flow area), such that jets 34 create a relatively greater flow restriction through ports 32 of housing 12. In other words, jets 34 are configured to distribute or flow a preselected portion of the fluid entering circulation valve 10 from drill string flowpath 13 to the annulus 9.

Further, the actuation of circulation valve 10 between the closed and open positions may be adjusted by adjusting the degree of flow restriction provided by jets 94 and 100. Particularly, jets 94 and 100 having a relatively high flow restriction (e.g., jets 94 and 100 including relatively small apertures 94*c* and 100*c*) will cause circulation valve 10 to actuate from the closed position to the open position at a relatively low flow rate of fluid along drill string flow path 13 (i.e., a relatively low second operating flow rate). Conversely, jets 94 and 100 having a relatively low flow restriction (e.g., jets 94 and 100 including relatively large apertures 94*c* and 100*c*) will cause circulation valve 10 to actuate from the closed position to the open position at a relatively high flow rate of fluid along drill string flow path 13 (i.e., a relatively high second operating flow rate).

Figure 10:
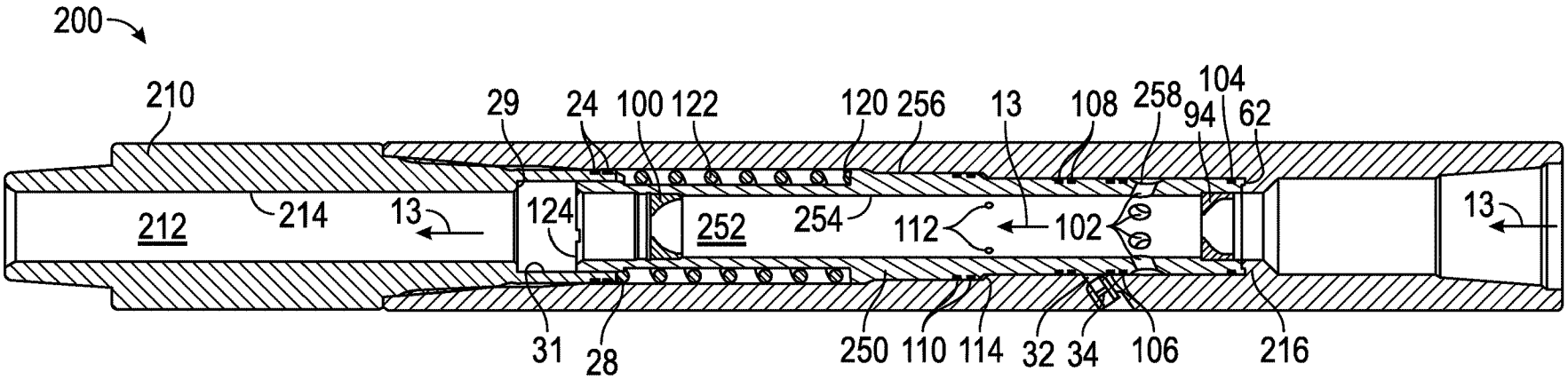
FIG. 10 is a side cross-sectional view of another embodiment of a circulation valve of the drilling system of FIG. 1 in accordance with principles disclosed herein.

Referring to FIG. 10, another embodiment of an annulus boost or circulation valve 200 of drilling system 1 is shown. Circulation valve 200 has features in common with circulation valve 10 discussed above, and shared features are labeled similarly. In the embodiment shown in FIG. 10, circulation valve 200 includes an outer housing 210 and a sliding sleeve 250 disposed within a central bore 212 of housing 210. Outer housing 210 includes a central bore 212 extending between upper and lower ends of housing 210 and defined by a generally cylindrical inner surface 214. Sliding sleeve 250 includes a central bore 252 extending between upper and lower ends of sleeve 250 and defined by a generally cylindrical inner surface 258. In this arrangement, fluid communication is provided between bore 212 of housing 210 and bore 252 of sleeve 250, establishing drillstring flowpath 13.

In the embodiment shown in FIG. 10, circulation valve 200 does not include a valve sleeve disposed radially between the housing 210 and sliding sleeve 250. Instead, the inner surface 214 of housing 210 includes a radially inwards extending flange 216. Flange 216 of inner surface 214 defines the upper annular shoulder 62 that is disposed directly adjacent an upper end of sliding sleeve 250 when circulation valve 200 is disposed in a closed position (shown in FIG. 10). In addition, in this embodiment sliding sleeve 250 is permitted to rotate relative housing 210. Thus, a generally cylindrical outer surface 256 of sliding sleeve 250 includes an annular groove 258 extending radially therein, where annular groove 258 is axially aligned with upper ports 102. In this arrangement, when circulation valve 200 is in the open position fluid communication may be established between radial ports 32 of housing 210 and the upper ports 102 of sliding sleeve 250 irrespective of the angular orientation of sliding sleeve 250 relative housing 210 via annular groove 258. In other words, when circulation valve 200 is disposed in the open position and upper ports 102 of sliding sleeve 250 and radial ports 32 of housing 210 are circumferentially misaligned, fluid flows along a flowpath from upper ports 102, circumferentially along annular groove 258, and into radial ports 32 of housing 210.

While exemplary embodiments have been shown and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied. Furthermore, thought the openings in the plate carriers are shown as circles, they may include other shapes such as ovals or squares. Accordingly, it is intended that the following claims be interpreted to embrace all such variations and modifications.

What is claimed is:

1. A circulation valve, comprising:

a housing having a throughbore and a housing port; and a sliding sleeve having a central axis and disposed in the throughbore of the housing and having a first radial port, wherein the sliding sleeve comprises:

a first jet configured to provide a first pressure drop in a fluid flowing therethrough, and disposed in a throughbore of the sliding sleeve;

a second jet configured to provide a second pressure drop in a fluid flowing therethrough, wherein the second jet is disposed in the throughbore of the sliding sleeve and is axially spaced from the first jet; and a second radial port axially spaced from the first radial port and configured to provide fluid communication between the throughbore of the sliding sleeve and a first annular shoulder of the sliding sleeve;

wherein, when the sliding sleeve is disposed in a first position, fluid flow between the throughbore of the sliding sleeve and the housing port is restricted, and when the sliding sleeve is disposed in a second position, fluid flow between the throughbore of the sliding sleeve and the housing port is permitted;

wherein the sliding sleeve is actuated between the first and second positions in response to a change in a flowrate of a fluid flow passing through the circulation valve; and wherein a net pressure force urging the sliding sleeve towards the second position is applied to the sliding sleeve in response to the fluid communication between the throughbore of the sliding sleeve and the first annular shoulder.

2. The circulation valve of claim 1, wherein the first jet and the second jet are each configured to allow for the passage of a tool therethrough.

3. The circulation valve of claim 1, wherein, when the sliding sleeve is in the second position, fluid communication is provided between the throughbore of the sliding sleeve and an annular flowpath surrounding the circulation valve.

4. The circulation valve of claim 1, further comprising a biasing member disposed in the throughbore of the housing between an annular shoulder of the sliding sleeve and an annular shoulder of the housing to exert a biasing force against the sliding sleeve.

5. The circulation valve of claim 4, wherein:

in response to a first flow rate of fluid flowing through the circulation valve, the biasing member retains the sliding sleeve in the first position;

in response to a second flow rate of fluid flowing through the circulation valve, the sliding sleeve is actuated from the first position to the second position; and the second flow rate is greater than the first flow rate.

6. The circulation valve of claim 1, wherein the sliding sleeve is actuated from the first position to the second position in response to a pressure force applied to the sliding sleeve from the first pressure drop and the second pressure drop in a fluid flow through the first jet and the second jet.

7. The circulation valve of claim 1, wherein a jet is disposed in the housing port configured to provide a pressure drop in a fluid flowing therethrough.

8. The circulation valve of claim 1, wherein the sliding sleeve further comprises an annular groove extending into an outer surface of the sliding sleeve, wherein the annular groove is axially aligned with the first radial port.

9. A circulation valve, comprising:

a housing having a throughbore and a housing port having a jet disposed therein, wherein the jet is configured to provide a pressure drop in a fluid flowing therethrough; and a sliding sleeve having a central axis and disposed in the throughbore of the housing, wherein the sliding sleeve comprises a throughbore, a first radial port, and a second radial port axially spaced from the first radial port and configured to provide fluid communication between the throughbore of the sliding sleeve and a first annular shoulder of the sliding sleeve;

wherein, when the sliding sleeve is disposed in a first position, fluid flow between the throughbore of the sliding sleeve and the housing port is restricted;

wherein, when the sliding sleeve is disposed in a second position, fluid flow between the throughbore of the sliding sleeve and the housing port is permitted;

wherein, in response to a fluid flow through the circulation valve, a first pressure drop is created in the fluid flow at a first flow restriction disposed in the throughbore of the sliding sleeve, and a second pressure drop is created in the fluid flow at a second flow restriction disposed in the throughbore of the sliding sleeve; and wherein a net pressure force urging the sliding sleeve towards the second position is applied to the sliding sleeve in response to the fluid communication between the throughbore of the sliding sleeve and the first annular shoulder.

10. The circulation valve of claim 9, wherein:

the sliding sleeve is actuated between the first and second positions in response to a change in a flowrate of a fluid flow passing through the circulation valve; and the jet disposed in the housing port is configured to divert a preselected portion of the fluid flow entering the circulation valve through the first radial port of the sliding sleeve.

11. The circulation valve of claim 9, wherein the first pressure drop is greater than the second pressure drop.

12. The circulation valve of claim 9, wherein the sliding sleeve further comprises:

a first jet disposed in the throughbore of the sliding sleeve, wherein the first jet configured to provide the first pressure drop in response to the fluid flow; and a second jet disposed in the throughbore of the sliding sleeve and axially spaced from the first jet, wherein the second jet configured to provide the second pressure drop in response to the fluid flow.

13. The circulation valve of claim 12, wherein the first jet and the second jet are each configured to allow for the passage of a tool therethrough.

14. The circulation valve of claim 9, wherein, when the sliding sleeve is in the second position, fluid communication is provided between the throughbore of the sliding sleeve and an annular flowpath surrounding the circulation valve.

15. The circulation valve of claim 9, further comprising a biasing member disposed in the throughbore of the housing between an annular shoulder of the sliding sleeve and an annular shoulder of the housing, wherein the biasing member is configured to exert a biasing force against the sliding sleeve.

16. The circulation valve of claim 9, wherein the sliding sleeve further comprises a plurality of circumferentially spaced slots extending radially into an outer surface of the sliding sleeve, wherein the slots are configured to provide fluid communication between a second annular shoulder of the sliding sleeve and the throughbore of the housing.

17. A method of controlling fluid flow through a circulation valve disposed in a borehole, comprising:

flowing a fluid at a first flowrate through a first jet and a second jet disposed in a throughbore of a sliding sleeve having a central axis and disposed in a housing of the circulation valve;

flowing the fluid at a second flowrate through the first jet and the second jet to actuate the sliding sleeve from a first position to a second position;

flowing the fluid from the throughbore of the sliding sleeve through a first radial port of the sliding sleeve and through a housing port of the housing in response to actuating the sliding sleeve from the first position to a second position; and flowing the fluid from the throughbore of the sliding sleeve through a second radial port of the sliding sleeve which is axially spaced from the first radial port to provide fluid communication between the throughbore of the sliding sleeve and a first annular shoulder of the sliding sleeve.

18. The method of claim 17, further comprising:

producing a first pressure drop in the fluid flow as the fluid passes through the first jet; and producing a second pressure drop in the fluid flow as the fluid passes through the second jet.

19. The method of claim 18, further comprising, producing a pressure force on the sliding sleeve to actuate the sliding sleeve from the first position to the second position in response to producing the first pressure drop and the second pressure drop in the fluid flow.

20. The method of claim 18, wherein the first pressure drop is greater than the second pressure drop.

* * * * *